United States Patent [19]

Hill et al.

[11] 4,028,980

[45] June 14, 1977

[54] SOSTENUTO PIANO ACTION

[75] Inventors: Robert S. Hill; Lewis F. Herwig, both of Holly Springs, Miss.

[73] Assignee: The Wurlitzer Company, Chicago, Ill.

[22] Filed: Nov. 10, 1975

[21] Appl. No.: 630,266

[52] U.S. Cl. ..... 84/218

[51] Int. Cl.² ..... G10C 3/00

[58] Field of Search ..... 84/218, 216, 217, 245

[56] References Cited

UNITED STATES PATENTS

| | | | |
|---|---|---|---|
| 939,309 | 11/1909 | Peterson | 84/218 |
| 1,214,237 | 1/1917 | Steinway | 84/218 |
| 1,822,214 | 9/1931 | Hammond, Jr. | 84/218 |
| 2,542,307 | 2/1951 | Brown | 84/218 |
| 2,751,804 | 6/1956 | Comparetti | 84/255 |
| 3,747,461 | 7/1973 | Yui | 84/218 |

*Primary Examiner*—Stephen J. Tomsky
*Attorney, Agent, or Firm*—Olson, Trexler, Wolters, Bushnell & Fosse, Ltd.

[57] ABSTRACT

A sostenuto piano action is provided for upright pianos. Each damper is provided at the top rear thereof with a rubber fitting having a catcher flange or tab thereon. A pivoted sostenuto knife similar to that in a grand piano has a blade thereon which, upon pivoting of the sostenuto knife, will catch or engage the catcher tab or flange of each fitting to retain retracted such dampers as are in retracted position. With the knife pivoted to sostenuto position and additional notes played thereafter the flanges will bump the backside of the knife, but will not be caught. Spring biased elbows or hinges are provided in the damper levers to allow "breaking" of the levers at such time so as to avoid providing a strange feel to the pianist. The rubber nature of the fitting prevents any noise at such time.

3 Claims, 5 Drawing Figures

SOSTENUTO PIANO ACTION

BACKGROUND OF THE PRESENT INVENTION

Grand pianos for many years have been provided with three pedals. The rightmost pedal is a sustaining pedal, sometimes known as a forte pedal. This pedal is connected to mechanism which, upon depression of the pedal, retracts all of the dampers of the piano, whereby all notes played will have a maximum sustain. Similar pedals and mechanisms are conventionally provided on upright pianos.

The leftmost or soft pedal in a grand piano effects movement of the keyboard and actions a slight distance to one side so that only two of the three strings are struck in the middle and treble section, and only of the two in the bichord section. In an upright piano the hammers are simply lifted somewhat closer to the strings so that velocity is reduced.

Most grand pianos have a third center pedal, sometimes known as a sostenuto pedal. By the use of this pedal a note or notes pressed down before the pedal is depressed may be sustained after the fingers have left the keys. There is no effect on subsequently played notes. Some upright pianos have a center third pedal producing a true sostenuto action, however, most upright pianos having a third center pedal do not produce a true sostenuto action. Usually, when the third center pedal is provided on an upright piano it simply provides bass sustain or is a dummy.

OBJECT AND SUMMARY OF THE PRESENT INVENTION

It is an object of the present invention to provide a true sostenuto pedal and action in an upright piano.

Furthermore, it is an object of the present invention to provide such a true sostenuto action in which all working parts are at the top of the action for easy access and do not require removal of the action for servicing.

In accordance with the present invention, the rear end of each damper head is provided with a rubber fitting having a catcher flange or tab thereon. A sostenuto knife is provided to the rear of the damper head and on a slightly lower level, having a blade thereon pivotable from substantially horizontal to substantially vertical position. With the blade in horizontal position the catcher flanges on the damper head fittings can simply pass over the sostenuto knife. However, if one or more dampers are retracted due to the playing of a corresponding note or notes and the sostenuto knife is pivoted to raise the knife to vertical position, then the knife catches each of the flanges or tabs of the retracted dampers, and thereby to hold such dampers in retracted position. If additional notes are then played, the backsides of the flanges or tabs simply engage the knife, quietly due to the rubber composition of the fittings. In order to prevent an unnatural feel or touch to a key being so played, each damper head is provided with a spring biased elbow which allows the damper lever to "break" when the corresponding tab or flange engages the sostenuto knife blade.

DESCRIPTION OF THE DRAWINGS

The present invention will best be understood with reference to the drawings and the accompanying specification hereinafter wherein FIG. 1 comprises a perspective view of a piano incorporating the present invention.

DETAILED DISCLOSURE OF A PREFERRED FORM OF THE PRESENT INVENTION

Figure 1:
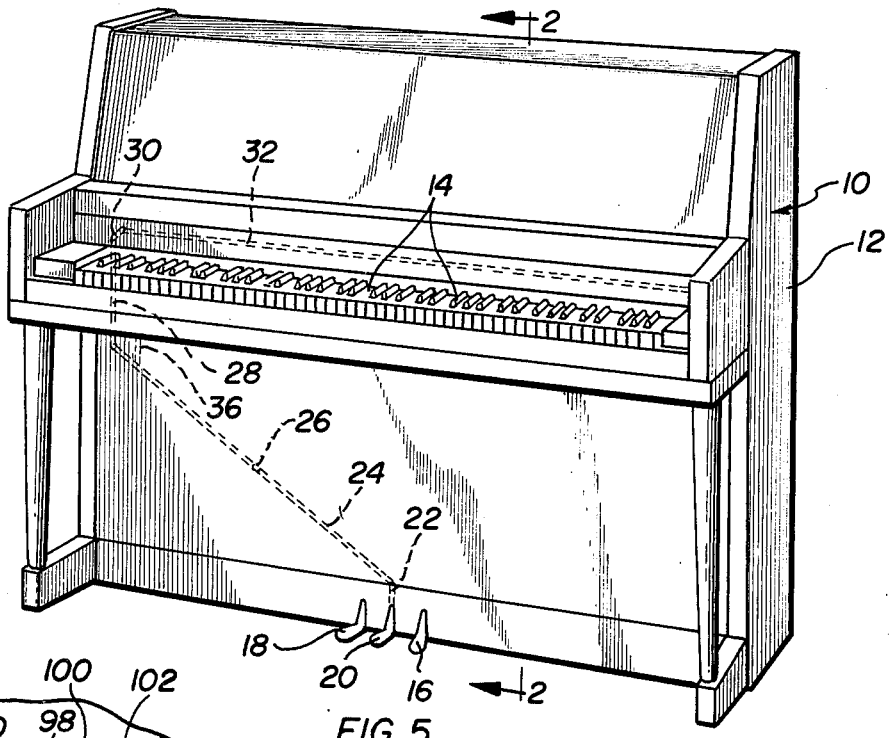

An upright piano 10 of generally conventional construction is shown in FIG. 1, including a case 12 having the usual strings and actions therein. The various keys 14 comprising a keyboard are exposed at the front, and the piano is provided at the lower front with three pedals. The rightmost pedal 16 comprises a full sustaining pedal. The leftmost pedal 18 comprises a soft pedal, while the center pedal 20 comprises a sostenuto pedal. The sostenuto pedal is connected by means of a push rod 22 and a pivoted rod 24 pivoted at 26. The rod conveniently is diagonally disposed, and is connected by means of a pull rod 28 to a crank lever 36 to a sostenuto knife 32. A tension spring 36 normally biased the foregoing parts to rest position.

Figure 2:
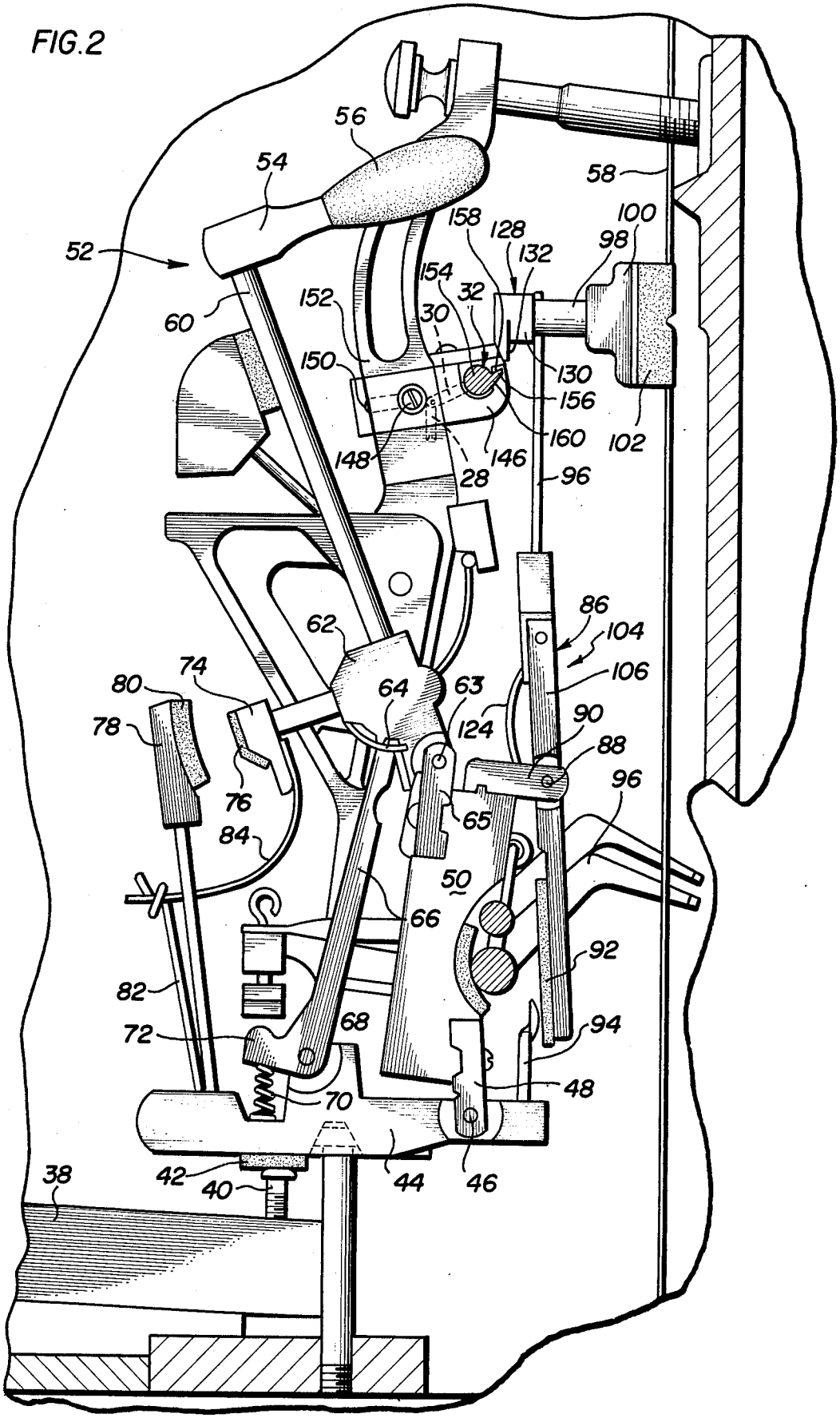
FIG. 2 comprises a vertical sectional view through the action of such piano as taken substantially along the line 2—2 in FIG. 1.

Turning to FIG. 2 there will be seen a piano action of generally conventional construction incorporating the present invention. A piano action includes a key 38 having a capstan screw 40 thereon, bearing up against a felt pad 42 on a wippen 44 pivoted at 46 on a wippen-flange 48. The flange 48 is secured as by a common groove and screw arrangement to an action rail 50.

A hammer 52 is provided with a head 54 having a felt pad 56 thereon for engagement with a corresponding piano string 58 or, more accurately, a unison or bichord of strings, except in the lower bass register in which the strings are wrapped with copper wire. The hammer 52 includes a shank 60 on which the head is mounted, and the shank is mounted in a hammer butt 62 pivoted at 63 on a hammer flange 65 mounted on the action rail 50. The hammer butt 62 is provided with a felt 64 against which is the upper end of a jack 65. The jack 65 is pivoted at 68 on the wippen, and a spring 70 is compressed between the wippen and the jack knuckle 72.

A backstop 78 having a felt pad 80 thereon is engageable with the felt 76 on the backstop to catch the hammer butt for repeated action as is well known in the art. Also, in accordance with conventional practice, a bridle wire 82 upstands from the wippen, and bridle tape 84 interconnects the top of the bridle wire and the backstop 74.

Turning to the more pertinent portions of the piano actions of the structure, there will be seen a damper lever 86 about which more will be said hereafter. The damper lever is pivoted at 88 on a damper flange 90 mounted on the action rail 50, and is provided at its lower end with a felt pad 92 engageable by a spoon 94 on the wippen 44 for pivoting the damper to non-damping position upon playing of the respective key 38, all as is well known in the art. Also, as it is well know, lever means 96 is provided linked to the sustaining pedal 16 for holding the damper lever in position of the pedal 16.

Continuing upwardly, the damper lever is provided at the upper end with the usual damper wire 96 carrying a damper block 98 which, in the present instance, is a cylindrical wooden member and which carries at its far end a damper block 100 having a damper felt 102 on the front thereof engageable with the respective wire or plurality of wires 58.

Figure 3:
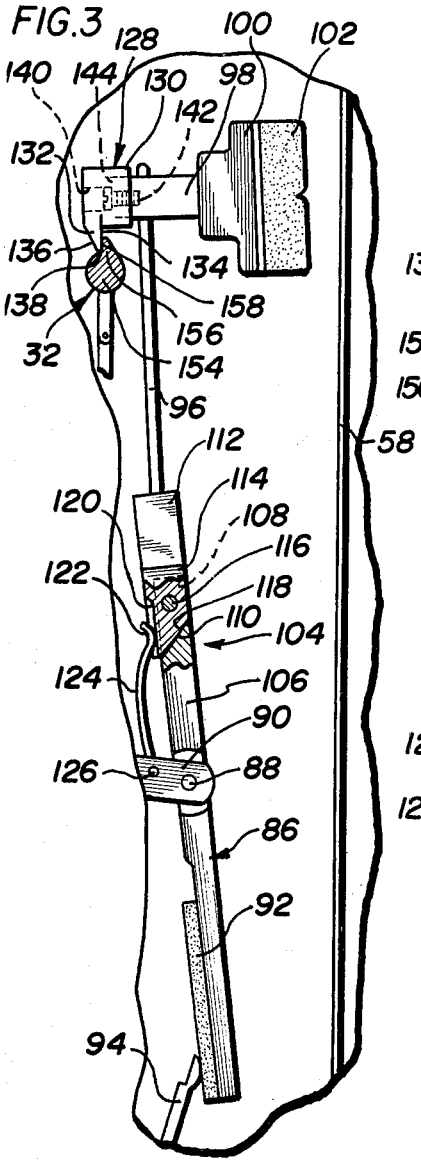
FIG. 3 is a fragmentary view similar to a portion of FIG. 2 showing a damper lever held in retracted position by the sostenuto mechanism of the present invention.
Figure 5:
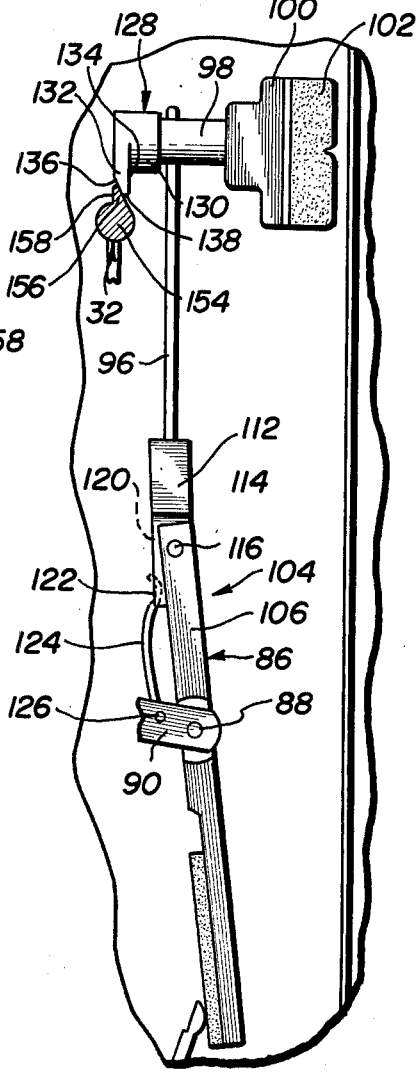
FIG. 5 is a fragmentary vertical view similar to FIG. 3 and showing a subsequently played note with the catcher flange or tab engaging the sostenuto knife blade.
Figure 4:
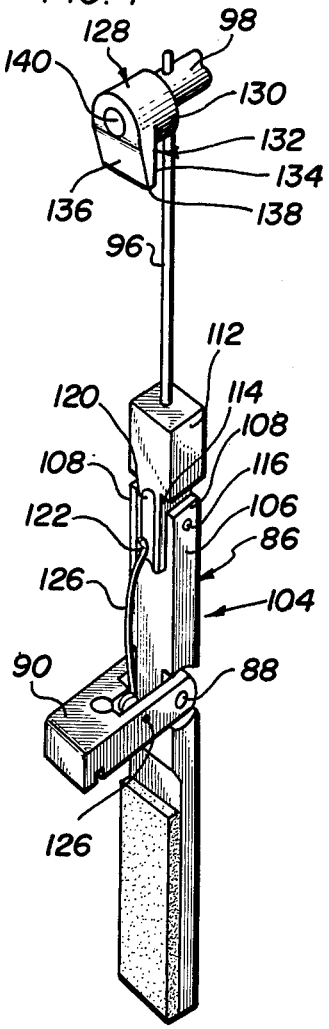
FIG. 4 is a perspective view of the damper mechanism corresponding to FIG. 3

With continued reference to FIG. 2, and with further reference to FIG. 3 – 5, the foregoing described damper is identified by the numeral 104. The damper lever is of a two-part construction, comprising a lower or main lever portion or body 106. The upper end of the damper lever body comprises a pair of spaced apart upstanding arms 108, with a planar ramp 110 inclined upwardly toward the piano string 58. The upper portion of the body 106 is broken away in FIG. 3 to show this ramp. A damper lever extension 112 is provided with a restricted depending portion 114 received between the arms 108 and pivoted on a pin 116 extending between the arms. The lower end of the extension 114 is provided with a slightly convex oblique surface 118 engageable with the ramp 110. A vertical depression 120 in the depending portion 114 of the damper lever extension 112 receives the upward angled end 122 of the upstanding arm 124 of the usual damper biasing spring encircling a pin 126 in the damper flange 90. It will be observed that the angled portion 122 of the upper end of the biasing spring 124 engages in the depression 120 in the depending portion 114 of the extension 112 well below the pin 116, whereby simultaneously to bias the entire damper lever in a clockwise direction, and to hold the extension 112 straight with regard to the body 106 of the damper lever 86, the surface 118 bottoming against the ramp 110.

The cylinder or damper block 98 is provided at its rear end with an elastomeric sostenuto fitting 128 comprising mainly a cylindrical body 130 fitted over the rear end of the cylinder 98 and glued thereto, and a depending tab or flange 132. The tab or flange has a front face 134 parallel to the damper wire 96 and an oblique rear face 136 tapering to a narrow edge 138 between it and the front face 134.

As best will be seen in FIG. 3 the fitting 128 is provided with a bore 140 extending axially through the cylindrical body 130 to permit access to a screw 142 threaded into a metal fitting in damper block 98 and having the end thereof bearing against the damper wire 96 adjustably to hold the damper head on the damper wire. A counter bore 144 communicates with bore 140 and actually receives the rear end of the block or cylinder 98.

The sostenuto knife 32 is journaled in brackets 146 (FIG. 2) adjustably mounted by means including a bolt 148 and slot 150 on the piano brackets 152. This sostenuto knife is similar to that on a conventional grand piano and comprises an elongated cylindrical body 154 conveniently made of brass, and having a generally radially extending blade 156 thereon. The blade is provided with a generally radial backface 158, and a generally tangential front face 160. In idle position the blade 156 extends generally toward the damper wire 96, and lies below the catcher flange 132. When the sostenuto pedal 20 is depressed the sostenuto knife 32 is pivoted about its axis to raise the blade to its upstanding position shown in FIG. 3 and 5. In this position, as shown specifically in FIG. 3, the radial face 158 of the knife blade engages the front face 134 of the catcher tab or flange 132 of the sostenutual fitting and thereby to hold in retracted position any dampers that are in retracted position upon such pivoting of the damper knife.

If one or more subsequent notes are played, the corresponding dampers are moved away from the string or strings and the rear oblique face 136 of the catcher flange strikes the tangential face 160 of the blade. This striking action is quiet due to the elastomeric nature of the fitting 128. However, notwithstanding the resilience of this fitting, a certain amount of additional key pressure would be felt by the pianist were it not for the pivoted extension 112 of the damper lever which allows the damper lever to break somewhat as seen in FIG. 5 as contrasted with FIG. 3. Thus, the backward engagement of the damper fitting with the sostenuto knife blade is not felt by the pianist.

It is worthy of note that the sostenuto fittings 128 and the mounting of the sostenuto blade 32 are adjacent the upper portions of the piano action, and hence are readily accessible for adjustment as contrasted with certain prior art sostenuto mechanisms which are located at the bottom of the action, and which require time-consuming removal of the action for any sort of adjustment.

Thus, we have now disclosed a full sostenuto action for an upright piano requiring only the addition of a few parts, with modification of few existing parts. The addition of such a sostenuto system to an existing piano design is simple and economical. Furthermore, the parts themselves are inexpensive whereby the full sostenuto system can be added to an upright piano at a minimum of cost. The sostenuto system as disclosed herein is not manifested to the pianist by an unusual or different playing of the piano, such as differences from the normal touch.

A specific example of the invention is herein shown and described. It is for illustrative purposes only. Various changes in structure will no doubt occur to those skilled in the art, and it will be understood as forming a part of the present invention insofar as they fall within the spirit and scope of the appended claims.

The invention is claimed as follows:

1. A sostenuto system system for an upright piano having a damper which is retracted from a string upon playing a respective note comprising an upstanding damper lever having a damper wire mounting said damper at the top of said lever said damper including a damper block with a damper pad on the front thereof and a rearwardly extending cylindrical rod receiving said damper wire substantially diametrically thereof, a screw threaded into the rear of said rod and bearing against said wire to lock said damper rod and block in place on said wire, and an elastomeric sostenuto fitting comprising a hollow cylindrical body receiving and secured to the rear of said rod, said fitting being apertured to accommodate said screw and having a lateral tab thereon, damper restraining means adjacent said damper and adjacent the top of said damper lever and having a portion thereof normally disposed out of the path of said tab, and manually operable means for moving said restraining means portion into said path to engage behind the tab of a retracted damper to prevent return of said damper into damper engagement with a respective string.

2. A sostenuto system for an upright piano having a plurality of strings and a plurality of dampers respectively for at least certain of said strings, each of said dampers being pivotally mounted for retraction from a corresponding string upon playing of a respective note, comprising a protuberance of each of said dampers, damper retraining means mounted adjacent said dampers and having a portion thereof normally disposed out of the paths of said protuberances, and manually operable means for moving said restraining means into said paths to engage behind the protuberances of retracted dampers to prevent return of such dampers into damping engagement with the corresponding strings, each of said dampers including a substantially upright damper lever hinged intermediate its ends above its pivoted mounting and spring biased to limit position, each protuberance being mounted adjacent the upper end of a respective lever, retraction of subsequent dampers with said restraining means in restraining position resulting in engagement of said protuberance with said restraining means and breaking of said levers at the hinged position.

3. A sostenuto system as set forth in claim 2 including common spring means resiliently uring each damper into engagement with the corresponding string and simultaneously biasing the hinged lever to limit position.

* * * * *